US005603425A

United States Patent [19]

Breeden

[11] Patent Number: 5,603,425

[45] Date of Patent: Feb. 18, 1997

[54] RADIATOR CAP

[75] Inventor: Anthony P. Breeden, Wokingham, England

[73] Assignee: Western Thomson Controls Limited, Woodley, England

[21] Appl. No.: 406,046

[22] Filed: Mar. 17, 1995

[51] Int. Cl.[6] ..... B65D 51/16

[52] U.S. Cl. ..... 220/203.06; 220/203.26; 220/360; 220/DIG. 32

[58] Field of Search ..... 220/203.01, 203.04, 220/203.05, 203.06, 203.24, 203.25, 203.26, 203.28, 360, DIG. 32

[56] References Cited

U.S. PATENT DOCUMENTS 5,071,020 12/1991 Reutter ..... 220/203.06

FOREIGN PATENT DOCUMENTS 2174797 4/1986 United Kingdom .

*Primary Examiner*—Stephen K. Cronin
*Attorney, Agent, or Firm*—Paul & Paul

[57] ABSTRACT

A vessel for a fluid, the vessel having a filling opening and a cap removably mounted on the vessel for closing the filling opening, the filling opening being defined by a tubular conduit having a vent port located in its wall, the cap including an elongate sealing member which is axially insertable into the conduit, the sealing member carrying a circumferentially extending main seal for providing sealing engagement between axially extending opposed faces of the conduit wall and the sealing member, the sealing member being axially movably mounted on the vessel for axial movement between a first axially static position whereat the main seal resides at an inner location relative to the vent port to sealingly isolate the vent port from the interior of the vessel and to a second axially static position whereat the main seal resides at an outer location relative to the vent port to permit direct fluid communication between the vent port and the interior of the vessel.

8 Claims, 2 Drawing Sheets

RADIATOR CAP

BACKGROUND OF THE INVENTION

The present invention relates to vessels for pressurised fluid systems and more particularly, but not exclusively, to vessels for the cooling systems of automotive vehicles.

It is necessary for vessels, such as bottles, in pressurised fluid cooling systems in vehicles to be occasionally filled with cooling fluid. The vessel is therefore normally provided with a removable pressure relief/sealing cap which closes a filling opening. An example of a pressure relief/sealing cap to which the invention relates is described in our UK Patent No. 2174797.

It is desirable to provide a vessel in which the cap provides a reliable seal to prevent leakage from the filling opening during normal use and also during removal of the cap for filling.

SUMMARY OF THE INVENTION

According to the present invention there is provided a vessel for a fluid, the vessel having a filling opening and a cap removably mounted on the vessel for closing the filling opening, the filling opening being defined by a tubular conduit having a vent port located in its wall, the cap including an elongate sealing member which is axially insertable into the conduit, the sealing member carrying a circumferentially extending main seal for providing sealing engagement between axially extending opposed faces of the conduit wall and the sealing member, the sealing member being axially movably mounted on the vessel for axial movement between a first axially static position whereat the main seal resides at an inner location relative to the vent port to sealingly isolate the vent port from the interior of the vessel and to a second axially static position whereat the main seal resides at an outer location relative to the vent port to permit direct fluid communication between the vent port and the interior of the vessel.

BRIEF DESCRIPTION OF THE DRAWINGS

Various aspects of the present invention are hereinafter described with reference to the accompanying drawings in which.

DETAILED DESCRIPTION OF PREFERRED EMBODIMENTS

Figure 1:
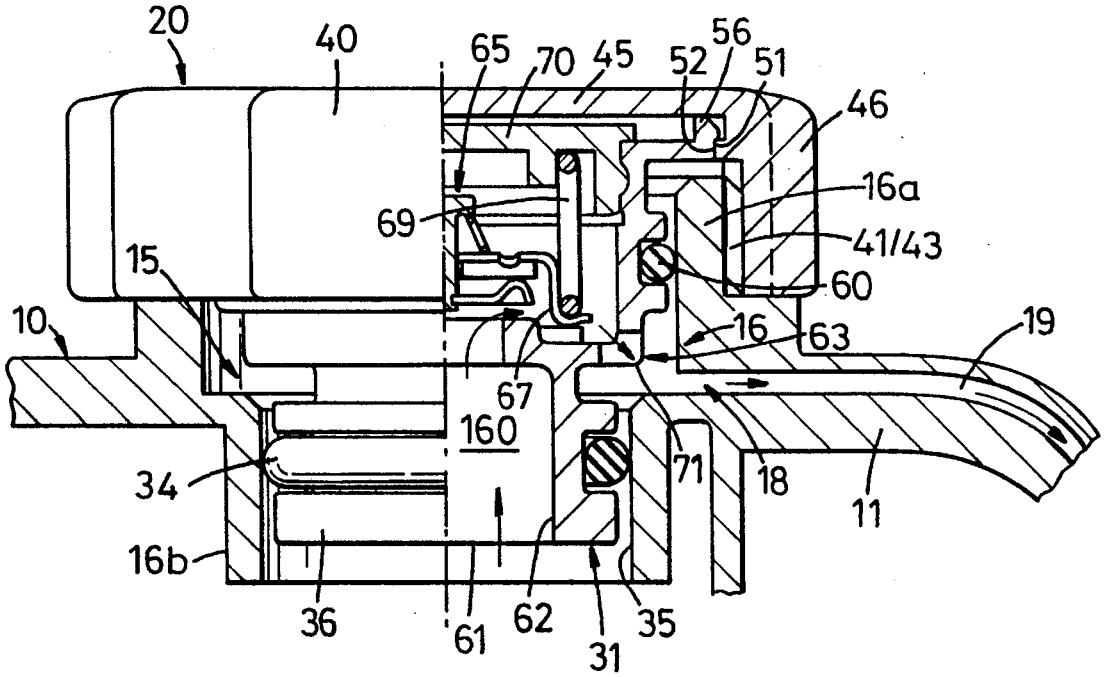
FIG. 1 is a part sectional view of a first embodiment according to the present invention in which the cap is fully seated on the bottle.

Referring initially to FIG. 1 there is shown a bottle 10 for storing a pressurised fluid such as a liquid used as a coolant for an internal combustion engine.

The bottle may be made from any suitable material, a suitable plastics material being preferred.

The bottle 10 has a filling opening 15 defined by a tubular conduit 16 which is preferably formed integrally with an upper wall 11 of the bottle. In the embodiment shown, the tubular conduit 16 has an exterior portion 16*a* and an interior portion 16*b*.

A pressure relief/sealing cap 20 is axially removably mounted on the conduit 16 for closing the filling opening 15. Removal of the cap 20 enables filling of the bottle 10 through the opening 15.

The conduit 16 has a vent port 18 formed in its wall which communicates with the interior of the conduit 16 and with a tubular vent conduit 19. The conduit 19 is shown as being formed integrally within wall 11 of bottle 10 and it continues along wall 11 to an outlet port (not shown) located at a convenient position. The outlet port may be connected to a pipe to convey vented fluid to a remote location or, if a pipe is not connected, vented fluid may be permitted to discharge directly from the outlet port.

The tubular vent conduit 19 is preferably integrally formed during moulding of the bottle.

It will be appreciated however that the conduit 19 may be separately formed.

The cap 20 includes an elongate sealing member 31 which is insertable axially into the conduit 16. The sealing member 31 is preferably moulded from a suitable plastics material. The sealing member 31 carries a main seal 34 which, in the position shown in FIG. 1, provides sealing engagement between axially extending opposed faces 35, 36 of the wall of conduit 16 and the sealing member 31. The seal 34 is formed from a suitable elastomeric material.

The sealing member 31 is mounted on cap member 40 which includes a radially extending body portion 45 surrounded by an axially depending annular skirt 46. The inner surface of the skirt 46 includes an inner screw thread 41 for co-operation with an outer Screw thread 43 formed on the outer face of conduit portion 16*a*. The sealing member 31 is preferably mounted on the cap member 40 so as to permit relative rotation therebetween. In the illustrated embodiment, this is achieved by the provision of an annular rib 50 which projects radially inwards from the skirt 46 to define an annular bearing face 51 which abuts against a shaft face 52 formed on the sealing member 31.

The sealing member 31 is provided with a lip formation 56 which co-operates with the cap member 40 to prevent relative axial movement between the sealing member 31 and cap member 40.

In this respect, the lip formation 56 has an end face which abuts against with the inner face 46 of the body portion 45 to prevent relative axial displacement in one direction and has a shoulder which co-operates with the rib 50 to prevent relative axial displacement in the opposite axial direction. Accordingly, axial displacement of the cap member 40, caused by rotation of the cap member 40 relative to conduit portion 16*a*, causes a similar axial displacement of seal member 31.

Figure 2:
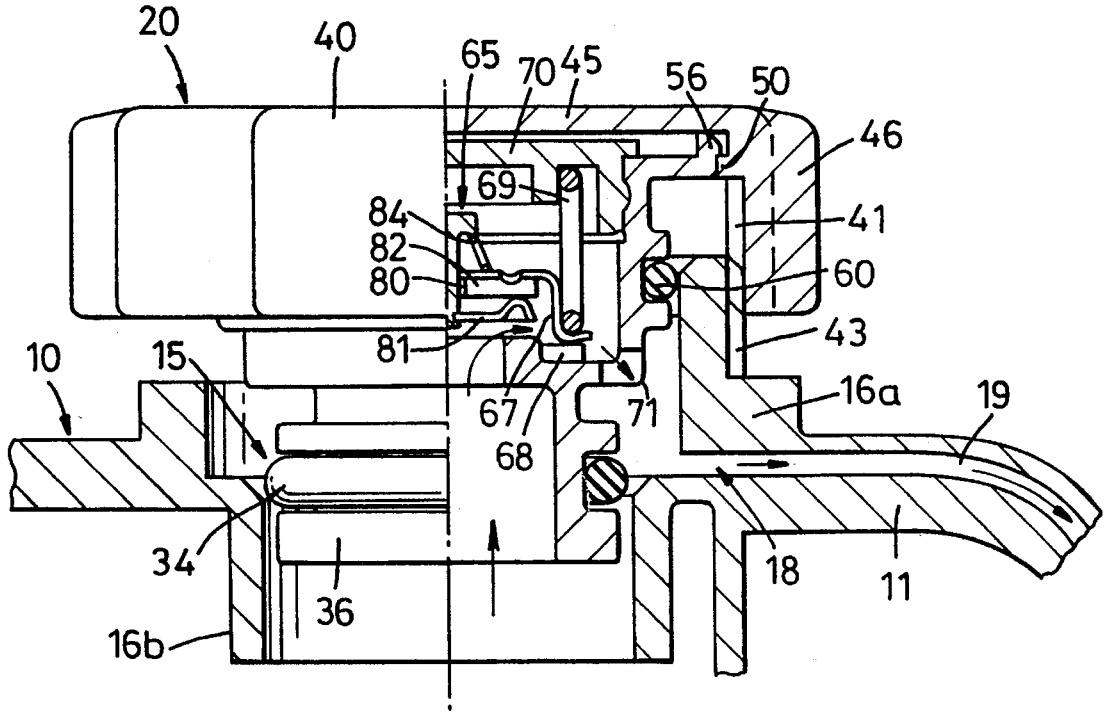
FIG. 2 is a similar view to FIG. 1 showing the cap partially removed from the bottle.

The axial length of screw threads 41, 43 are such as to enable the sealing member 31 to be axially moved between first and second axial positions illustrated in FIGS. 1 and 2 respectively. In the first axial position (as shown in FIG. 1) the seal 34 resides at an inner location relative to the vent port 18 so that the vent port 18 is sealing isolated from the interior of the bottle. In the first position, seal 34 engages with the second conduit portion 16*b*.

It will be appreciated that the axial spacing between the vent port 18 and the seal 34 when at the first position of the sealing member is not critical for achieving sealing isolation between the vent port 18 and the interior of the bottle. Thus, once the seal 34 is located between the vent port 18 and the interior of the bottle a complete seal is provided.

Axial withdrawal of the sealing member 31 from conduit 16 is achieved by rotation of the cap member 40.

During axial withdrawal, the sling member 34 is moved to a second position (FIG. 2) whereat the seal 34 resides at an outer location relative to the vent port 18 such that the vent port 18 communicates with the interior of the bottle.

In such a position, pressurised fluid can escape to the exterior of tho bottle via vent conduit 19 prior to complete axial withdrawal of the sealing member 31 from the conduit 16.

As shown in the first embodiment, a secondary seal 60 is provided on the sealing member 31 at a location spaced axially from the seal 34. Seal 60 is positioned to sealingly engage with the conduit portion 16*a* and is preferably located so that when the sealing member 31 is in its second position, the seal 60 is still in sealing contact with the conduit portion 16*a*. In this way pressurised fluid is prevented from exiting from the upper axial end of conduit 16 whilst pressurised fluid is being vented through vent port 18.

The sealing member 31 preferably includes a fluid passageway 160 having an inlet port 61 and an outlet port 63.

The fluid passageway 160 is defined by a bore 62 extending axially through the sealing member 31, a lower end of the bore being open to define the inlet port and the upper end of the bore being dosed by an end cap 70. One or more circumferentially spaced apertures 71 are provided in the wall of the sealing member 31 to define the outlet port 63.

The inlet port 61 is located on the inner side of the seal 34 and the outlet port 63 is located on the outer side of the seal 34 such that fluid may flow along passageway 160 between the interior of the bottle and vent port 18 and so bypass the sealing engagement created by seal 34.

Fluid flow along the passageway 160 is controlled by a valve assembly 65 which is conveniently of conventional construction as described for example in our UK Patent 2174797.

The valve assembly 65 includes a, valve cup 67 which is biased into engagement with a valve seat 68 by a spring 69. The spring 69 is compressed between the cup 67 and the end cap 70. Accordingly, valve cup 67 acts as a pressure relief valve whereby fluid pressure in the bottle above a predetermined valve causes the cup 67 to lift off valve seat 68 to permit fluid to escape to the vent port 18.

When the passageway 160 is provided the seal 60 is also located such that when the sealing member 31 is at its first position, the seal 60 is positioned at an outer location relative to the vent port 18. In this way, during venting of pressurised fluid through valve assembly 65, fluid is isolated from the upper end of the conduit 16 by seal 60.

Preferably the valve cup 67 includes an aperture 80 closed by a valve member 81. The valve member 81 is biased into contact with a valve seat 82 by a spring 84 and by fluid pressure within the bottle.

Should pressure within the bottle fall below a predetermined value, the valve member 81 lifts off seat 82 to permit ingress of fluid from the vent port 18 into the bottle.

Figure 3:
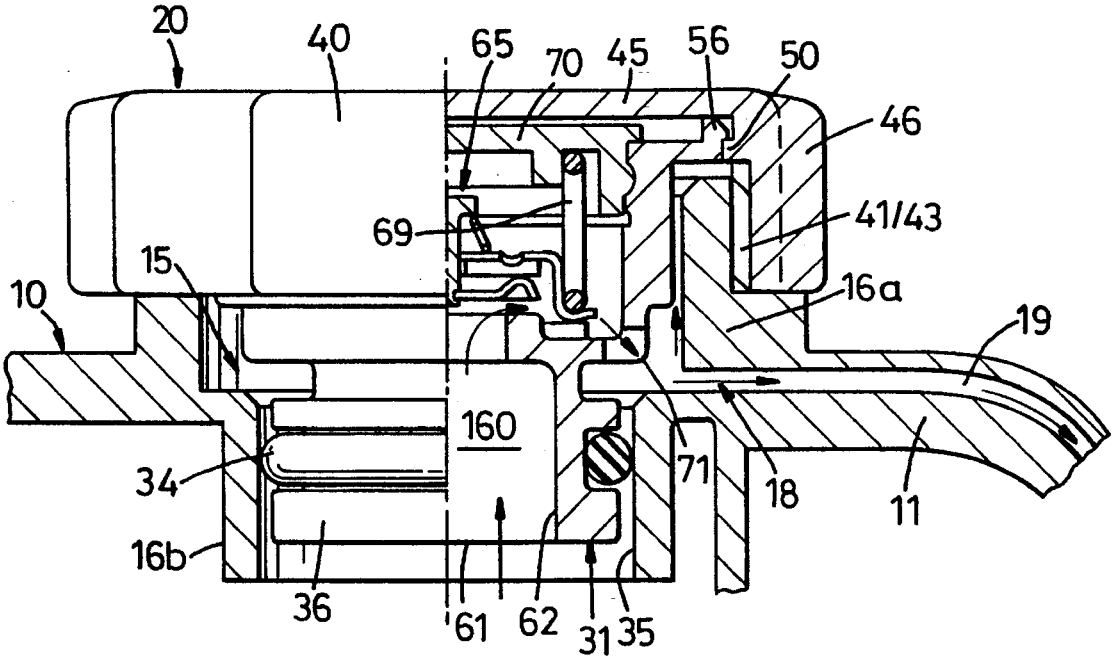
FIG. 3 is a part sectional view similar to FIG. 1 of a second embodiment according to the present invention.

The second embodiment shown in FIG. 3 is the same as that shown in FIGS. 1 and 2 with the exception that in FIG. 3 the secondary seal 60 has been omitted. In the second embodiment, ingress of fluid to the exterior of the bottle via the upper portion of the conduit 16 during venting of pressurised fluid through vent port 18 is prevented by sealing engagement between the co-operating screw threads 41, 43.

It will be appreciated that the sealing member 31 is statically held at its first and second positions by the inter-engagement of the screw threads 41, 43. Thus, fluid pressure within the bottle is unable to axially dislodge the sealing member 31 from the conduit 16.

Thus, when removing the cap 20 for filling of the bottle, the sealing member 31 is axially moved from its first position to a fully removed position by passing through the second position whereat the bottle is automatically vented prior to the cap 20 being fully removed from the bottle. This provides a safety feature for the operative.

It will be appreciated that the cap 20 may be attached to any vessel for containing a pressurised fluid. For example, the vessel may be the header tank of a vehicle radiator.

I claim:

1. A vessel for a fluid, the vessel having a filling opening and a cap removably mounted on the vessel for closing the filling opening, the filling opening being defined by a tubular conduit having a vent port located in its wall, the cap including an elongate sealing member which is axially insertable into the conduit, the cap further including a cap member rotatably mounted on the elongate sealing member so as to permit relative rotation therebetween about the axis of rotation of the cap member, the cap member and vessel having cooperating screw threads such that relative rotation between the cap member and vessel causes axial movement of the sealing member relative to the tubular conduit, the sealing member carrying a circumferentially extending main seal for providing sealing engagement between axially extending opposed faces of the conduit wall and the sealing member, the sealing member being axially movably mounted on the vessel for axial movement between a first axially static position whereat the main seal resides at an inner location relative to the vent port to sealingly isolate the vent port from the interior of the vessel and to a second axially static position whereat the main seal resides at an outer location relative to the vent port to permit direct fluid communication between the vent port and the interior of the vessel.

2. The vessel according to claim 1, wherein the vent port communicates with a tubular vent conduit formed integrally with a wall of the vessel.

3. The vessel according to claim 1, wherein the sealing member includes a fluid passageway for bypassing the main seal to provide fluid communication between the interior of the vessel and the vent port when the sealing member is at its first position, valve means being located in the fluid passageway to control flow of fluid therealong.

4. The vessel according to claim 3, wherein the valve means includes a pressure relief valve which operates to permit fluid flow from the interior of the vessel to the vent port along said passageway when fluid pressure within the vessel exceeds a predetermined value.

5. The vessel according to claim 4, wherein the valve means further includes a vacuum relief valve which permits ingress of fluid into the vessel along said passageway when pressure within the vessel falls below a predetermined value.

6. The vessel according to claim 3, wherein a secondary, circumferentially extending seal is provided on the sealing member for providing scaling engagement between the sealing member and the tubular conduit at a location axially spaced from the main seal, the secondary seal being located at a position such that when the sealing member is at its second position, the secondary seal sealingly isolates the vent port from the exterior of the vessel.

7. The vessel according to claim 3, wherein the cap comprises a radially extending body portion surrounded by an axially depending annular skirt, the annular skirt including a radially inwardly directed annular rib which defines an annular bearing face which abuts against a shaft face formed on the elongate sealing member.

8. The vessel according to claim 7, wherein the elongate sealing member has a closed end wall located adjacent to said radially extending body portion of the cap member, the valve means including a valve cup biased axially away from said end wall into sealing contact with a valve seat by a spring interposed between said end wall and said valve cup.

* * * * *